US011173354B2

(12) United States Patent
Jordan

(10) Patent No.: US 11,173,354 B2
(45) Date of Patent: Nov. 16, 2021

(54) EXERCISE BALL WITH INTERNAL HANDLE

(71) Applicant: Gripfit LLC, Washington, PA (US)

(72) Inventor: Thomas L. Jordan, Washington, PA (US)

(73) Assignee: GRIPFIT LLC, Washington, PA (US)

( * ) Notice: Subject to any disclaimer, the term of this patent is extended or adjusted under 35 U.S.C. 154(b) by 0 days.

(21) Appl. No.: 16/419,671

(22) Filed: May 22, 2019

(65) Prior Publication Data

US 2019/0269981 A1 Sep. 5, 2019

Related U.S. Application Data

(63) Continuation-in-part of application No. PCT/US2017/062742, filed on Nov. 21, 2017.
(Continued)

(51) Int. Cl.
*A63B 43/02* (2006.01)
*A63B 21/00* (2006.01)
(Continued)

(52) U.S. Cl.
CPC ..... *A63B 43/02* (2013.01); *A63B 21/028* (2013.01); *A63B 21/072* (2013.01);
(Continued)

(58) Field of Classification Search
CPC ..... A63B 65/06; A63B 21/06–08
See application file for complete search history.

(56) References Cited

U.S. PATENT DOCUMENTS 113,966 A * 4/1871 Ballou ..... A63B 21/075
482/108
421,447 A * 2/1890 Stewart ..... A63B 71/145
2/18

(Continued)

FOREIGN PATENT DOCUMENTS

CN 202342414 U 7/2012
DE 202012000254 U1 * 5/2012 ..... A63B 65/06
WO 2015191914 A1 12/2015

OTHER PUBLICATIONS

Rogue Fitness, "Rogue Thompson Fatbells", https://www.roguefitness.com/rouge-thompson-fatbells, accessed on Apr. 18, 2019.

(Continued)

*Primary Examiner* — Nyca T Nguyen
(74) *Attorney, Agent, or Firm* — The Webb Law Firm

(57) ABSTRACT

A fitness ball includes a ball portion having a generally spherical-shaped resilient shell, a pocket disposed in the ball portion and defining an opening in the ball portion, and a handle extending from a first point on an inner surface of the pocket to a second point on the inner surface of the pocket. In some embodiments, the fitness ball further includes an impact-absorbent filler material disposed in an inner cavity defined by the resilient shell and the pocket. In other embodiments, the fitness ball includes one or more gel inserts embedded in the pocket to cushion impact of a user's hand with the pocket. In other embodiments, the pocket is adhered to the resilient shell by an adhesive disposed between an interfacing portion of the resilient shell and a corresponding lip of the pocket which overlaps the interfacing portion of the resilient shell.

18 Claims, 16 Drawing Sheets

Related U.S. Application Data

(60) Provisional application No. 62/425,900, filed on Nov. 23, 2016.

(51) Int. Cl.

| | |
|---|---|
| ***A63B 21/072*** | (2006.01) |
| ***A63B 23/12*** | (2006.01) |
| ***A63B 65/06*** | (2006.01) |
| ***A63B 21/02*** | (2006.01) |
| ***A63B 39/00*** | (2006.01) |
| *A63B 71/06* | (2006.01) |
| *A63B 71/00* | (2006.01) |

(52) U.S. Cl.

CPC ..... *A63B 21/4035* (2015.10); *A63B 39/00* (2013.01); *A63B 21/4019* (2015.10); *A63B 21/4043* (2015.10); *A63B 23/12* (2013.01); *A63B 65/06* (2013.01); *A63B 71/0686* (2013.01); *A63B 2071/0063* (2013.01); *A63B 2071/0694* (2013.01); *A63B 2225/09* (2013.01)

(56) References Cited

U.S. PATENT DOCUMENTS

| | | | | |
|---|---|---|---|---|
| 3,185,476 | A * | 5/1965 | Fechner | A63B 43/02 473/596 |
| 4,880,228 | A * | 11/1989 | Caruthers | A63B 21/0605 482/108 |
| D372,945 | S * | 8/1996 | Morgan | A63B 43/02 D21/682 |
| 5,735,776 | A | 4/1998 | Swezey et al. | |
| 6,190,292 | B1 | 2/2001 | Panes | |
| 6,387,022 | B1 * | 5/2002 | Smith | A63B 43/02 482/106 |
| 6,672,993 | B2 * | 1/2004 | Stout | A63B 21/0084 482/55 |
| D498,799 | S | 11/2004 | Kerry | |
| D515,652 | S * | 2/2006 | McCreath | A63B 21/22 D21/787 |
| 7,214,205 | B2 | 5/2007 | Sils | |
| D552,696 | S | 10/2007 | Hallar | |
| 7,306,464 | B2 * | 12/2007 | Long | A63B 69/004 434/247 |
| 7,585,262 | B1 * | 9/2009 | Vayntraub | A63B 23/12 482/141 |
| 7,789,810 | B2 * | 9/2010 | Le | A63B 69/004 482/83 |
| 7,993,250 | B2 | 8/2011 | Abbott | |
| 8,382,647 | B1 * | 2/2013 | Hodes | A63B 21/075 482/108 |
| 8,454,485 | B1 * | 6/2013 | Hodes | A63B 21/0726 482/108 |
| 8,636,625 | B2 | 1/2014 | Johnson | |
| 8,870,719 | B2 | 10/2014 | Johnson et al. | |
| D769,990 | S | 10/2016 | Jung | |
| D779,599 | S | 2/2017 | Jung | |
| 9,833,653 | B2 * | 12/2017 | Bradford | A63B 23/12 |
| 10,010,470 | B2 * | 7/2018 | Bradford | A61H 15/0092 |
| 10,058,727 | B2 * | 8/2018 | Smith | A63B 21/072 |
| 10,188,893 | B2 * | 1/2019 | Johnson | A63B 21/072 |
| 10,220,243 | B2 * | 3/2019 | Koegel | A63B 21/4035 |
| 10,569,120 | B2 * | 2/2020 | Sorin | A63B 21/4035 |
| 2003/0134727 | A1 * | 7/2003 | Yu | A63B 21/22 482/110 |
| 2004/0220022 | A1 * | 11/2004 | McCreath | A63B 69/26 482/83 |
| 2006/0211545 | A1 * | 9/2006 | Smyer | A63B 25/00 482/75 |
| 2011/0077135 | A1 | 3/2011 | Abbott | |
| 2013/0059701 | A1 * | 3/2013 | Cruz | A63B 23/1236 482/108 |
| 2013/0274076 | A1 * | 10/2013 | Smith | A63B 23/1236 482/105 |
| 2014/0141944 | A1 | 5/2014 | Johnson et al. | |
| 2015/0360074 | A1 | 12/2015 | Jung | |
| 2016/0175678 | A1 | 6/2016 | Branch | |
| 2016/0317894 | A1 * | 11/2016 | Salcedo | A63B 41/00 |
| 2019/0168060 | A1 * | 6/2019 | Laurence | A63B 21/4035 |

OTHER PUBLICATIONS

Online Review of Rogue Fatbell, http://www.garagegymreviews.com/rogue-thompson-fatbells-review/, downloaded from the internet Apr. 4, 2019.

Motordoc—Variety of Fatbell Uses Nov. 6, 2015, https://www.youtube.com/watch?v=dmpapWHjpFc.

Sorinex—Center Mass Bells, https://www.sorinex.com/products/center-mass-bells, downloaded from the internet Apr. 4, 2019.

* cited by examiner

EXERCISE BALL WITH INTERNAL HANDLE

CROSS-REFERENCE TO RELATED APPLICATIONS

This application is a United States continuation-in-part application of International Application No. PCT/US2017/062742 filed Nov. 21, 2017, which claims the benefit of U.S. Provisional Patent Application No. 62/425,900 filed Nov. 23, 2016, the disclosures of which are hereby incorporated by reference in their entirety.

BACKGROUND OF THE INVENTION

Field of the Invention

This invention relates generally to fitness balls for use in various types of exercise regimens. More specifically, the invention relates to a fitness ball having an internal handle which may be used as a substitute for, or in conjunction with, traditional fitness equipment including but not limited to medicine balls, dumbbells, and kettlebells.

Description of Related Art

Medicine balls are used in a wide variety of exercise programs including strength training, cardiovascular training, and physical therapy. Conventionally, medicine balls are constructed of an impact-absorbent filler wrapped in a leather, rubber, or plastic cover or shell. The impact-absorbent filler provides a cushioning effect so that the medicine ball is suitable for exercises which involve impacts against a user's body, the floor, or other fitness equipment. The impact-absorbent filler may also be weighted depending on the nature of the activity the medicine ball is to be used for. Medicine balls are produced in a variety of weights and sizes to accommodate different users and exercise routines. Weight of a medicine ball is generally a function of the filler material used, the size of the ball, and the presence of a weighted inner core.

Some medicine balls include external handles to facilitate additional functionality or to reduce user fatigue caused from grasping the spherical outer surface of the medicine ball. For example, U.S. Pat. No. 8,636,625 to Johnson et al discloses a medicine ball having external handles on diametrically opposed sides of the ball. Johnson et al also discloses removable weighted elements contained within the medicine ball which allow the user to adjust the weight of the ball to suite his or her preferences and exercise needs.

However, current medicine balls are limited in the scope of exercise training for which they are suited. Other fitness equipment, such as dumbbells, kettlebells, punching bags, and/or any number of other equipment are needed to broaden the range of exercises that a user can perform. Especially for users who train at home, purchasing and storing an abundance of different fitness equipment is often both cost and space prohibitive. As such, fitness equipment which can be used for a broad range of different exercises is desirable.

Additionally, exercise devices which allow seamless transitions between individual exercises are highly desirable, particularly in circuit training or high intensity interval training routines. For example, a user may wish to perform a strength-training exercise such as a biceps curl, then, immediately and without changing equipment, perform another exercise such as shadowboxing. Thus, a need exists for multifunctional fitness equipment that allows a user to engage in several types of exercises in rapid sequence.

It is an object of the present invention to provide a fitness device which can be used to perform a wide range of exercises and reduce the amount of fitness equipment needed to complete a satisfactory training routine.

SUMMARY OF THE INVENTION

The present invention relates to a fitness ball including a ball portion having a generally spherical-shaped resilient shell, a pocket disposed in the ball portion and defining an opening in the ball portion, and a handle extending from a first point on an inner surface of the pocket to a second point on the inner surface of the pocket.

In a non-limiting embodiment, the fitness ball further includes an impact-absorbent filler material disposed in an inner cavity defined by the resilient shell and the pocket.

In another non-limiting embodiment, the filler material is selected to provide a predetermined weight to the fitness ball.

In another non-limiting embodiment, the handle is formed of a different material than the pocket and is embedded into the inner surface of the pocket at the first point and the second point.

In another non-limiting embodiment, the pocket and the handle of the fitness ball are formed as an integrally molded assembly.

In another non-limiting embodiment, the fitness ball further includes one or more gel inserts embedded in the pocket to cushion impact of a user's hand with the pocket.

In another non-limiting embodiment, the pocket is adhered to the resilient shell by an adhesive disposed between an interfacing portion of the resilient shell and a corresponding lip of the pocket which overlaps the interfacing portion of the resilient shell.

In another non-limiting embodiment, the pocket is adhered to the resilient shell by a stitched connection between the resilient shell and a lip of the pocket which overlaps an interfacing portion of the resilient shell.

In another non-limiting embodiment, the pocket is adhered to the resilient shell by riveted or stapled connection between the resilient shell and a lip of the pocket which overlaps an interfacing portion of the resilient shell.

In another non-limiting embodiment, the fitness ball further includes a programmable timer embedded in the fitness ball. The programmable timer emits an audible feedback or other sensory feedback signal to the user once a preset time interval has elapsed.

In another non-limiting embodiment, the filler material is a mixture of cotton and rubber pellets.

In another non-limiting embodiment, the filler material is silicone.

In other embodiments, the present invention relates to a fitness ball including a ball portion having a generally spherical-shaped resilient shell defining a cavity therein, and a handle assembly insertable into the cavity of the ball portion and removably attached to the ball portion. The handle assembly includes a handle pocket defining an opening configured to receive a user's hand, and a handle extending from a first point on an inner surface of the handle pocket to a second point on the inner surface of the pocket.

In a non-limiting embodiment, the fitness ball further includes a ball pocket disposed in the ball portion and defining an opening in the ball portion.

In a non-limiting embodiment, the handle assembly further includes a weighted portion integrally formed or attached to the handle pocket.

In another non-limiting embodiment, the weighted portion is arranged to evenly distribute the weight of the fitness ball about a predetermined point in space.

In another non-limiting embodiment, the ball pocket includes at least one deflectable tab configured to engage at least one corresponding aperture in the handle pocket. Engagement of the at least one deflectable tab and the at least one corresponding aperture removably attaches the ball pocket to the handle pocket.

In another non-limiting embodiment, the fitness ball further includes at least one set of stationary teeth extending from a first of the ball pocket and the handle pocket, and at least one set of ratcheting teeth extending from the other of the ball pocket and the handle pocket. The at least one set of ratcheting teeth are radially retractable away from the first of the ball pocket and the handle pocket. The at least one set of stationary teeth and the at least one set of ratcheting teeth are engageable to removably attach the handle pocket to the ball pocket.

In another non-limiting embodiment, the fitness ball further includes a disengagement element configured to retract the ratcheting teeth away from the stationary teeth.

In another non-limiting embodiment, the fitness ball further includes one or more threaded studs extending from the ball portion or the ball pocket, each of the one or more threaded studs corresponding to and extending through a bore defined by the handle pocket, and one or more thumb nuts, each of the one or more thumb nuts corresponding to and removably threaded onto one of the threaded studs. Threading the one or more thumb nuts onto the one or more threaded studs removably attaches the handle assembly to the ball portion.

In another non-limiting embodiment, the fitness ball further includes one or more straps extending from the handle assembly, the one or more straps removeably attachable to the ball portion.

In another non-limiting embodiment, the fitness ball further includes one or more weighted rings configured to fit concentrically around at least a portion of the handle pocket.

In another non-limiting embodiment, wherein a second of the one or more weighted rings is configured to fit concentrically around a first of the one or more weighted rings.

In another non-limiting embodiment, the fitness ball further includes a retaining ring configured to engage the handle pocket to secure the one or more weighted rings to the handle assembly.

Further non-limiting embodiments will now be set forth in the following numbered clauses.

Clause 1. A fitness ball comprising: a ball portion having a generally spherical-shaped resilient shell; a pocket disposed in the ball portion and defining an opening in the ball portion; and a handle extending from a first point on an inner surface of the pocket to a second point on the inner surface of the pocket.

Clause 2. The fitness ball of clause 1, further comprising an impact-absorbent filler material disposed in an inner cavity defined by the resilient shell and the pocket.

Clause 3. The fitness ball of clause 1 or 2, wherein the filler material is selected to provide a predetermined weight to the fitness ball.

Clause 4. The fitness ball of any of clauses 1 to 3, wherein the handle is formed of a different material than the pocket and is embedded into the inner surface of the pocket at the first point and the second point.

Clause 5. The fitness ball of any of clauses 1 to 4, wherein the pocket and the handle are formed as an integrally molded assembly.

Clause 6. The fitness ball of any of clauses 1 to 5, further comprising one or more gel inserts embedded in the pocket to cushion impact of a user's hand with the pocket.

Clause 7. The fitness ball of any of clauses 1 to 6, wherein the pocket is adhered to the resilient shell by an adhesive disposed between an interfacing portion of the resilient shell and a corresponding lip of the pocket which overlaps the interfacing portion of the resilient shell.

Clause 8. The fitness ball of any of clauses 1 to 7, wherein the pocket is adhered to the resilient shell by a stitched connection between the resilient shell and a lip of the pocket which overlaps an interfacing portion of the resilient shell.

Clause 9. The fitness ball of any of clauses 1 to 8, wherein the pocket is adhered to the resilient shell by riveted or stapled connection between the resilient shell and a lip of the pocket which overlaps an interfacing portion of the resilient shell.

Clause 10. The fitness ball of any of clauses 1 to 9, further comprising a programmable timer attached to the fitness ball, wherein the programmable timer emits a sensory feedback signal to the user once a preset time interval has elapsed.

Clause 11. The fitness ball of any of clauses 1 to 10, wherein the filler material is a mixture of cotton and rubber pellets.

Clause 12. The fitness ball of any of clauses 1 to 11, wherein the filler material is silicone.

Clause 13. The fitness ball of any of clauses 1 to 12, further comprising padding at least partially lining the pocket.

Clause 14. A fitness ball comprising: a ball portion having a generally spherical-shaped resilient shell defining a cavity therein; and a handle assembly insertable into the cavity of the ball portion and removably attached to the ball pocket, the handle assembly comprising: a handle pocket defining an opening configured to receive a user's hand; and a handle extending from a first point on an inner surface of the handle pocket to a second point on the inner surface of the pocket.

Clause 15. The fitness ball of clause 14, further comprising a ball pocket disposed in the ball portion and defining an opening in the ball portion.

Clause 16. The fitness ball of clause 14 or 15, wherein the handle assembly further comprises a weighted portion integrally formed or attached to the handle pocket.

Clause 17. The fitness ball of any of clauses 14 to 16, wherein the weighted portion is arranged to evenly distribute the weight of the fitness ball about a predetermined point in space.

Clause 18. The fitness ball of any of clauses 14 to 17, wherein the ball pocket comprises at least one deflectable tab configured to engage at least one corresponding aperture in the handle pocket, wherein engagement of the at least one deflectable tab and the at least one corresponding aperture removably attaches the ball pocket to the handle pocket.

Clause 19. The fitness ball of any of clauses 14 to 18, further comprising: at least one set of stationary teeth extending from a first of the ball pocket and the handle pocket; and at least one set of ratcheting teeth extending from the other of the ball pocket and the handle pocket, the at least one set of ratcheting teeth radially retractable away from the first of the ball pocket and the handle pocket, wherein the at least one set of stationary teeth and the at least one set of ratcheting teeth are engageable to removably attach the handle pocket to the ball pocket.

Clause 20. The fitness ball of any of clauses 14 to 19, further comprising a disengagement element configured to retract the ratcheting teeth away from the stationary teeth.

Clause 21. The fitness ball of any of clauses 14 to 20, further comprising: one or more threaded studs extending from the ball portion or the ball pocket, each of the one or more threaded studs corresponding to and extending through a bore defined by the handle pocket; and one or more thumb nuts, each of the one or more thumb nuts corresponding to and removably threaded onto one of the threaded studs, wherein threading the one or more thumb nuts onto the one or more threaded studs removably attaches the handle assembly to the ball portion.

Clause 22. The fitness ball of any of clauses 14 to 21, further comprising: one or more straps extending from the handle assembly, the one or more straps removeably attachable to the ball portion.

Clause 23. The fitness ball of any of clauses 14 to 22, further comprising: one or more weighted rings configured to fit concentrically around at least a portion of the handle pocket.

Clause 24. The fitness ball of any of clauses 14 to 23, wherein a second of the one or more weighted rings is configured to fit concentrically around a first of the one or more weighted rings.

Clause 25. The fitness ball of any of clauses 14 to 24, further comprising a retaining ring configured to engage the handle pocket to secure the one or more weighted rings to the handle assembly.

These and other features and characteristics of the fitness ball will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the disclosure. As used in the specification and the claims, the singular form of "a", "an", and "the" include plural referents unless the context clearly dictates otherwise.

BRIEF DESCRIPTION OF THE DRAWING(S)

DESCRIPTION OF THE INVENTION

Figure 1:
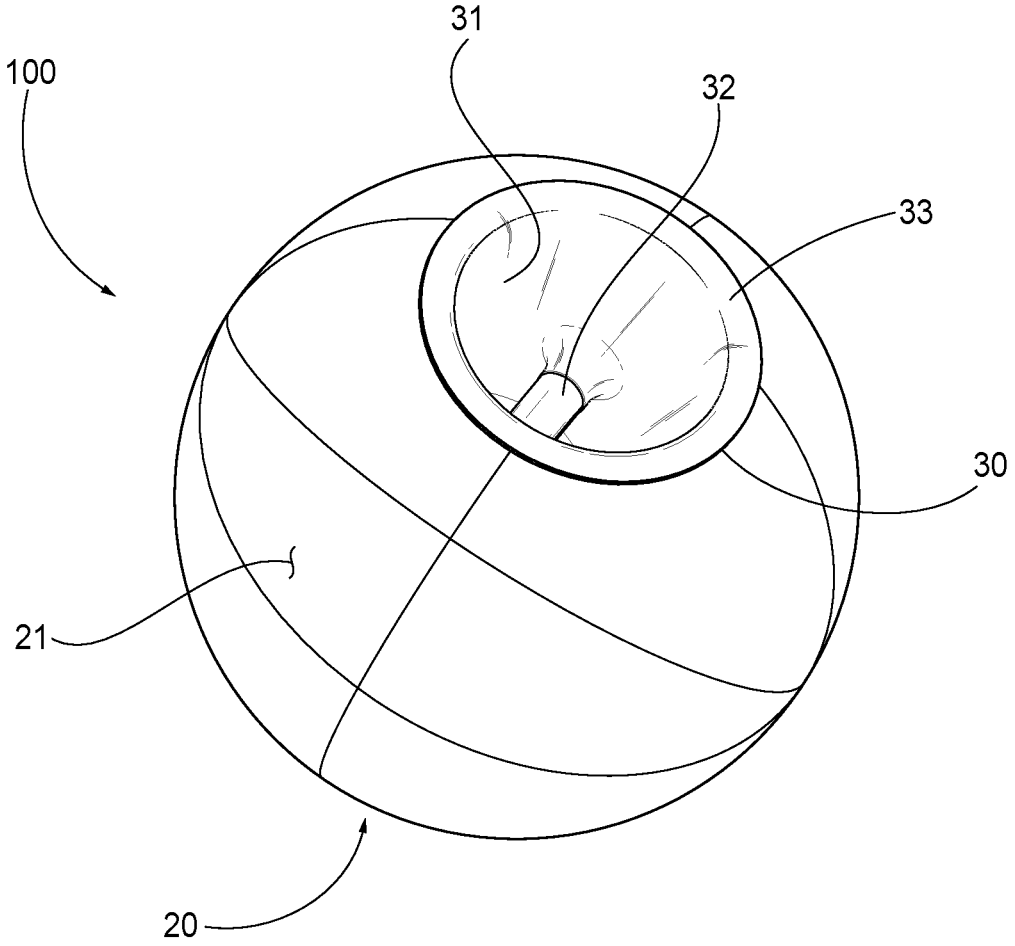
FIG. 1 is a perspective view of a fitness ball according to one embodiment of the present invention.

For the purposes of the description hereinafter, the terms "upper", "lower", "right", "left", "vertical", "horizontal", "top", "bottom", "side", "front", "back", "longitudinal", and derivatives thereof shall relate to the invention as it is oriented in the drawing figures. However, it is to be understood that the invention may assume alternative variations and step sequences, except where expressly specified to the contrary. It is also to be understood that the specific devices and processes illustrated in the attached drawings, and described in the following specification, are simply exemplary embodiments of the invention. Hence specific dimensions and physical characteristics related to the embodiments disclosed herein are not to be considered as limiting.

The present invention relates generally to fitness balls for use in various types of exercise regimens. Certain embodiments of the components of the fitness ball are illustrated in FIGS. 1-16, in which like reference numerals designate corresponding parts in the various figures.

Figure 2:
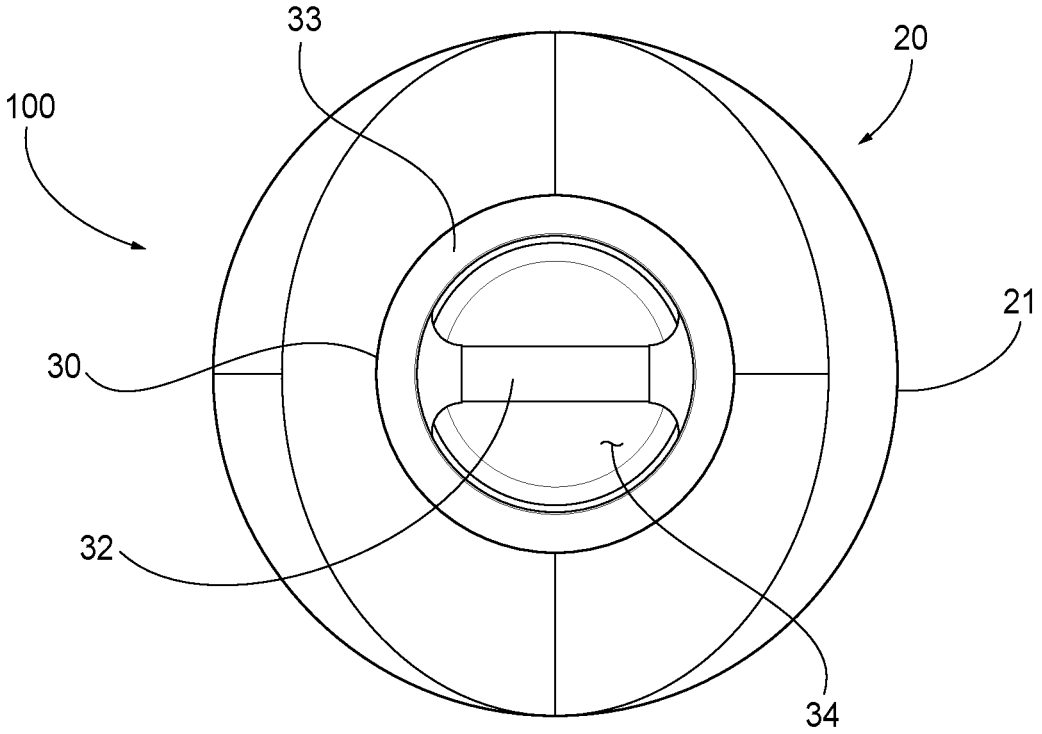
FIG. 2 is top view of the fitness ball of FIG. 1.

Referring now to FIGS. 1-2, a fitness ball 100 according to one embodiment of the present invention includes a ball portion 20 and a handle assembly 30 recessed into the ball portion 20. The ball portion 20 has a shell 21 which is generally spherical in shape and made from a resilient material such as leather or rubber. The shell 21 may be formed from a single piece of material or from multiple pieces of material stitched or otherwise adhered together to define the shape of the ball portion 20. The shell 21 is at least partially deformable so that when the shell 21 impacts a hard surface, such as a floor or wall, energy is absorbed by the ball portion 20 and neither the surface nor the fitness ball 100 is damaged.

The handle assembly 30 includes a handle pocket 31 recessed into the ball portion 20, into which a user may insert his or her hand. A lip 33 extends around the perimeter of the opening defined by the handle pocket 31 and provides an attachment interface 50 see (FIG. 3) between the ball portion 20 and the handle assembly 30. A handle 32 extends across the center of the handle pocket 31, from a first point on an inner surface of the handle pocket 31 to a second point on the inner surface of the handle pocket 31. The handle 32 is accessible through the opening defined by the handle pocket 31 so that the user may grasp the handle 32. The handle 32 may be weighted or made from a heavy material in order to impart additional weight to the fitness ball 100. The handle 32 may be integrally formed with the handle pocket 31, or the handle 32 may be a separate component attached to the handle pocket 31. In some embodiments, the handle pocket 31 and the handle 32 may be made from stitched leather. In other embodiments, the handle pocket 31 and the handle 32 may be a single component formed of a molded polymer such as a thermoplastic. In other embodiments, the handle pocket 31 may be formed of a molded polymer, and the handle 32 may be made from a metal, such as chrome-plated steel, and secured to the handle pocket 31 by fasteners on opposite ends of the handle 32. In other embodiments, the handle 32 may be embedded into the handle pocket 31 at diametrically opposing points on the inners surface of the handle pocket 31. Other method and materials for producing the handle 32 and handle pocket 31 will also be apparent to one having skill in the art, including combinations of the materials described above. For example, the handle pocket 31 and handle 32 may be formed as a single molded component with the handle 32 being hollow, and a metal rod or tube may be inserted into the hollow portion of the handle 32 for reinforcement and weight. The handle 32 may be cylindrical and may have a circular, ovular, elliptical, rounded, or polygonal cross section. In some embodiments, the shape of the handle 32 may be configured to engage a barbell or other piece of exercise equipment.

The location of the handle 32 within the handle pocket 31 may be determined based on the intended functionality of the fitness ball 100. The handle 32 may be located at the approximate center of the fitness ball 100, coincident with the center of mass of the fitness ball 100, so that the weight of the fitness ball 100 acts through the handle 32. If the user extends his or her hand away from his or her body, the weight of the fitness ball 100 causes the user's wrist to bend downward, requiring the user to compensate by engaging his or her wrist and forearm muscles. In this configuration, the fitness ball 100 can be used for wrist strengthening exercises, or to provide passive wrist strengthening while the user performs other movements with the fitness ball 100. Alternatively, the handle 32 may be located deeper in the handle pocket 31 than the center of the fitness ball 100. In this configuration, the weight of the fitness ball 100 may act behind the user's wrist, reducing the amount of stress on the user's wrist.

Referring now to FIG. 2, one or more resilient inserts 34 may be disposed in the base of the handle pocket 31 to prevent the user's hand from impacting the base of the handle pocket 31 and causing injury. The resilient inserts 34 may be made of a suitable impact absorbing material, such as gel, rubber, or padded leather.

Figure 3:
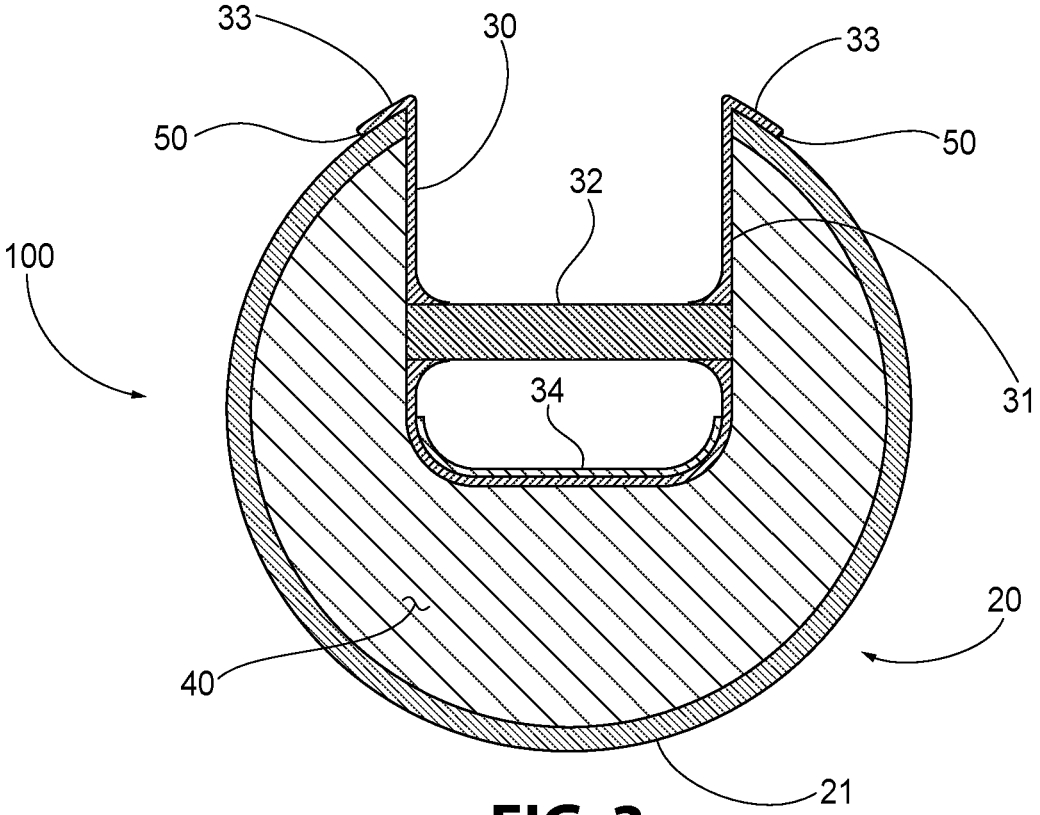
FIG. 3 is a cross sectional side view of the fitness ball of FIG. 1.
Figure 4:
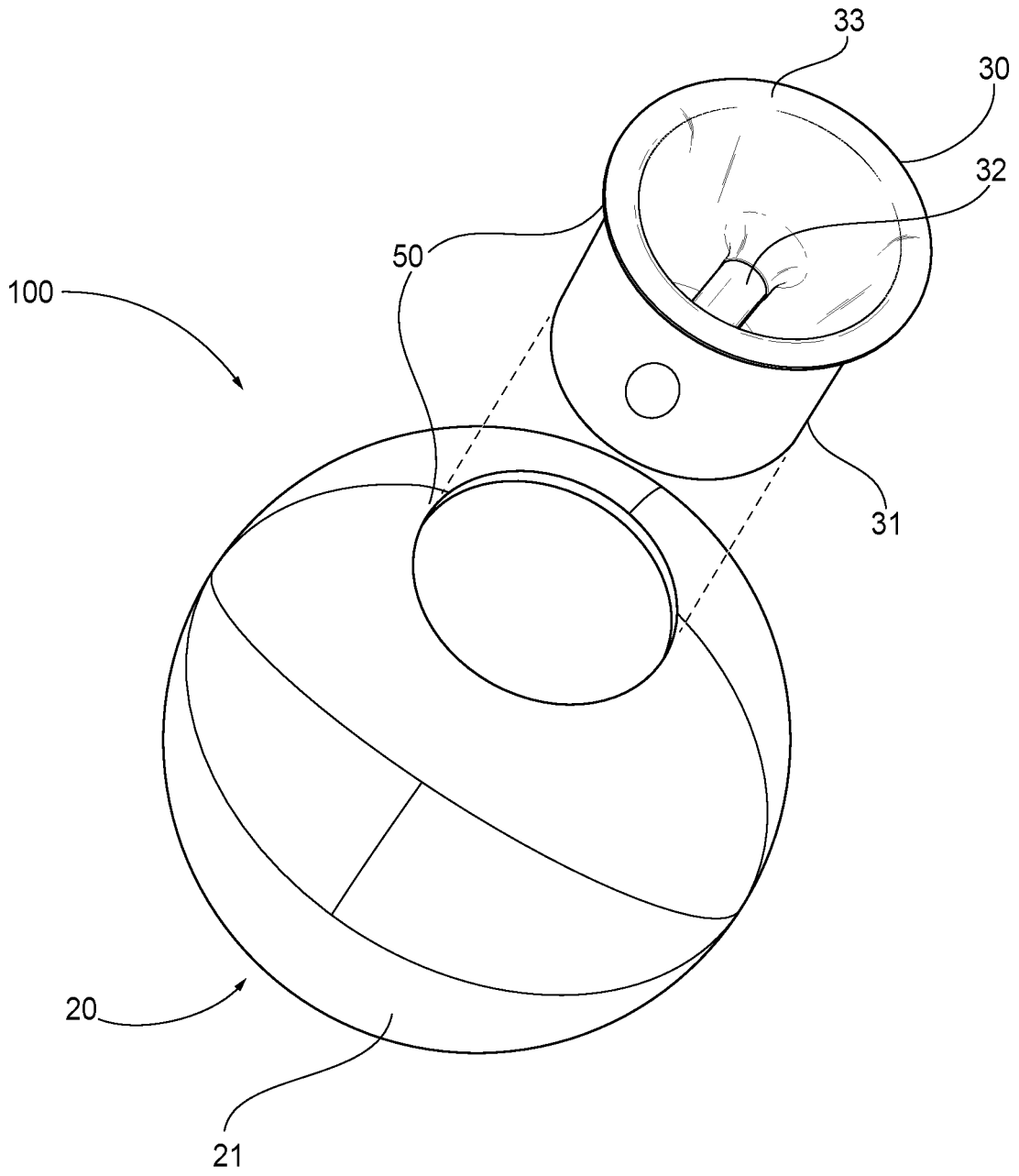
FIG. 4 is an exploded perspective view of the fitness ball of FIG. 1.

Referring now to FIG. 3, a filler material 40 may be disposed in an inner cavity defined by the shell 21 of the ball portion 20 and the handle pocket 31 of the handle assembly 30. The filler material 40 may be designed to add impact absorption and/or weight to the ball portion 20, depending on the intended use of the fitness ball 100. The filler material 22 may be gel, foam, sand, silicone, cotton, rubber pellets, or other suitable material or combination of suitable materials for providing impact absorption and/or weight.

The ball portion 20 of the fitness ball 100 is adhered to the handle assembly 30 at the attachment interface 50 between the lip 33 of the handle pocket 31 and the shell 21 of the ball portion 21. In one embodiment, the lip 33 may be secured to the shell 21 with glue or another adhesive.

Figure 5:
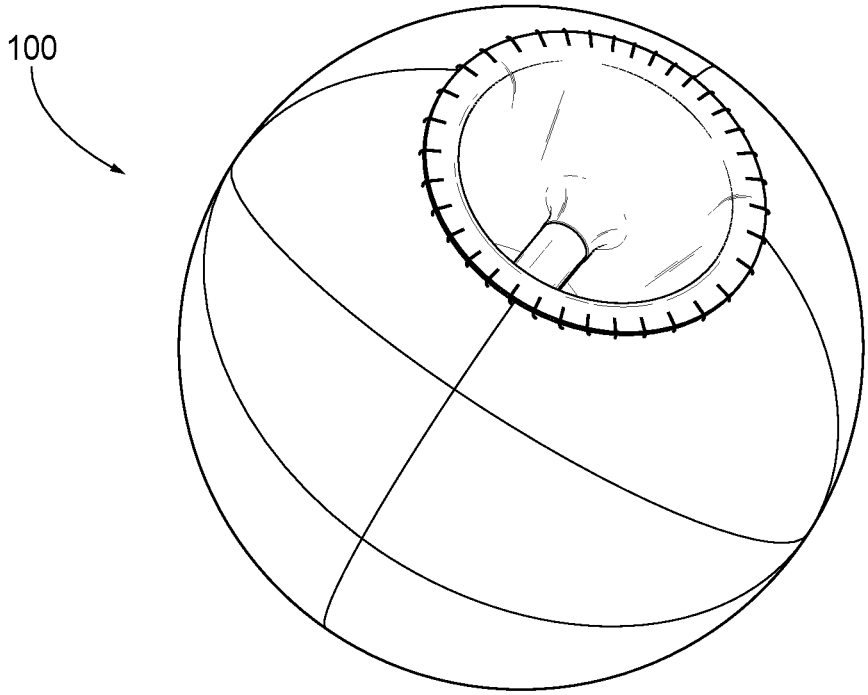
FIG. 5 is a perspective view of a fitness ball according to another embodiment of the present invention.
Figure 6:
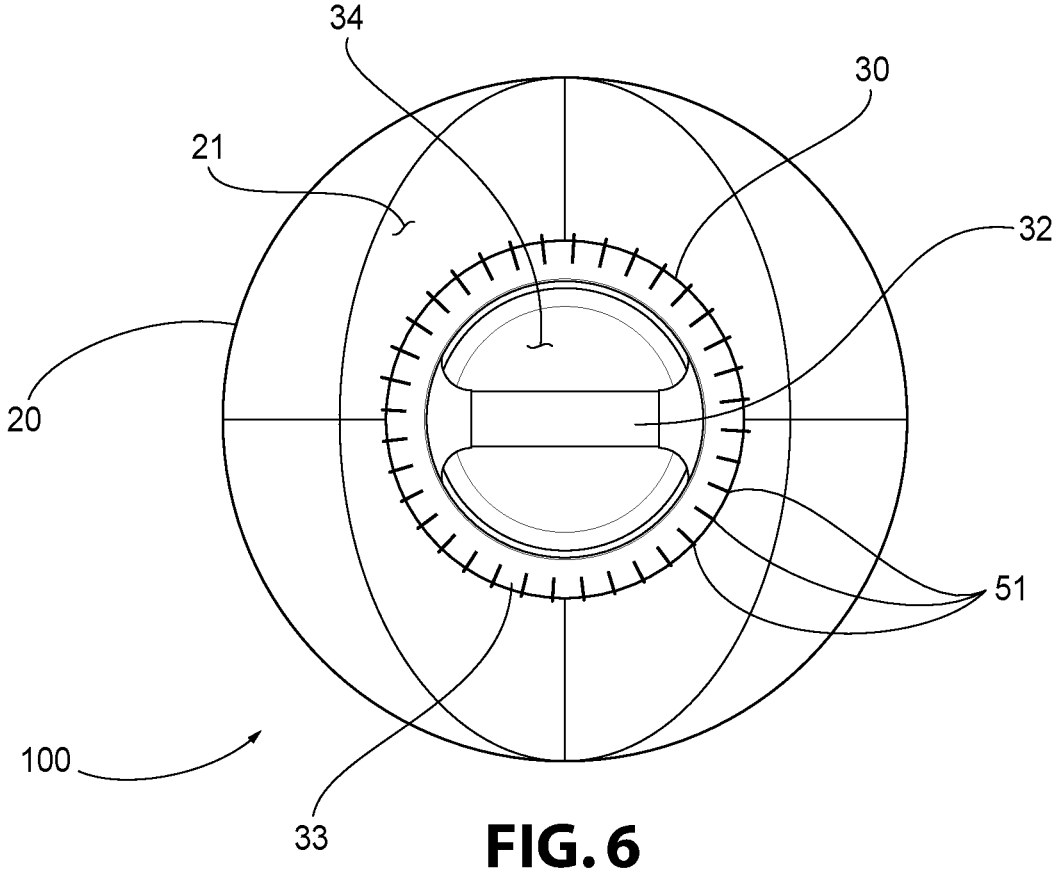
FIG. 6 is a top view of the fitness ball of FIG. 5.

Referring now to FIGS. 5-6, an alternative embodiment of the fitness ball 100 is shown, in which stitching 51 secures the lip 33 of the handle pocket 31 to the shell 21 ball portion 20. Other fastening means, such as rivets or staples, may also be used to secure the lip 33 to the shell 21 depending on the materials used for the handle assembly 30 and the shell 21.

Any of the components of the fitness ball 100 may be color-coded to distinguish fitness balls 100 of different weights. For example the handle pocket 31, the shell 21, the handle 32, or the inserts 34 may be colored to convey the weight of the fitness ball 100 to the user, based on a known coloring scheme.

Figure 7:
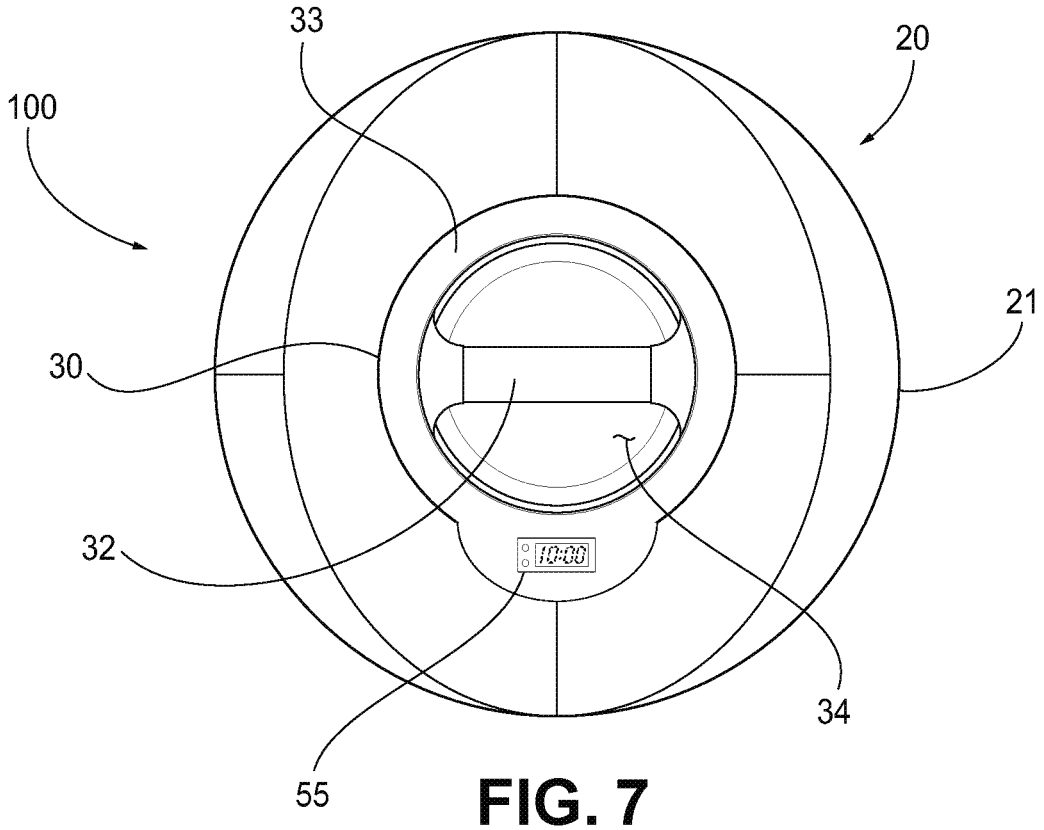
FIG. 7 is a top view of a fitness ball according to another embodiment of the present invention.

The fitness ball 100 may include additional features beneficial to a user's exercise regimen. FIG. 7 shows an embodiment of the fitness ball 100 which has an embedded programmable timer 55. The programmable timer 55 may include a countdown function which enables the user to input a series of timed training intervals. The programmable timer 55 provides audible or other sensory feedback to the user at the end of each of the training intervals, signaling the user to stop or move on to the next phase of his or her exercise regimen. The programmable timer 55 may also have a stopwatch function allowing the user to time exercise movements and/or sessions.

Figure 8:
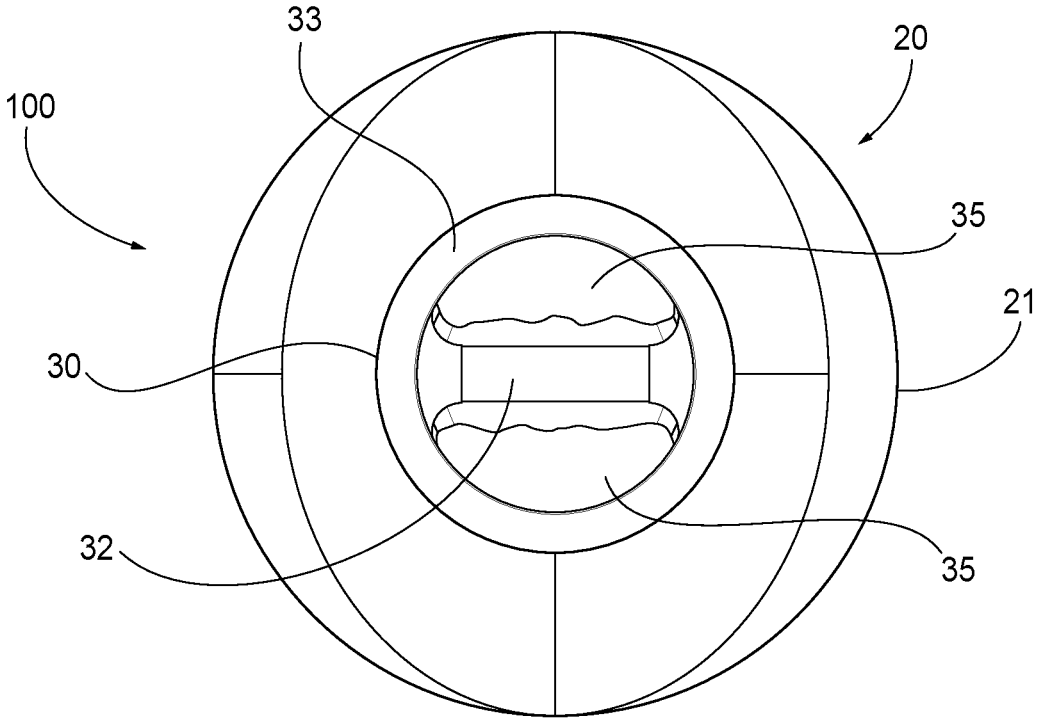
FIG. 8 is a top view of a fitness ball according to another embodiment of the present invention.
Figure 9:
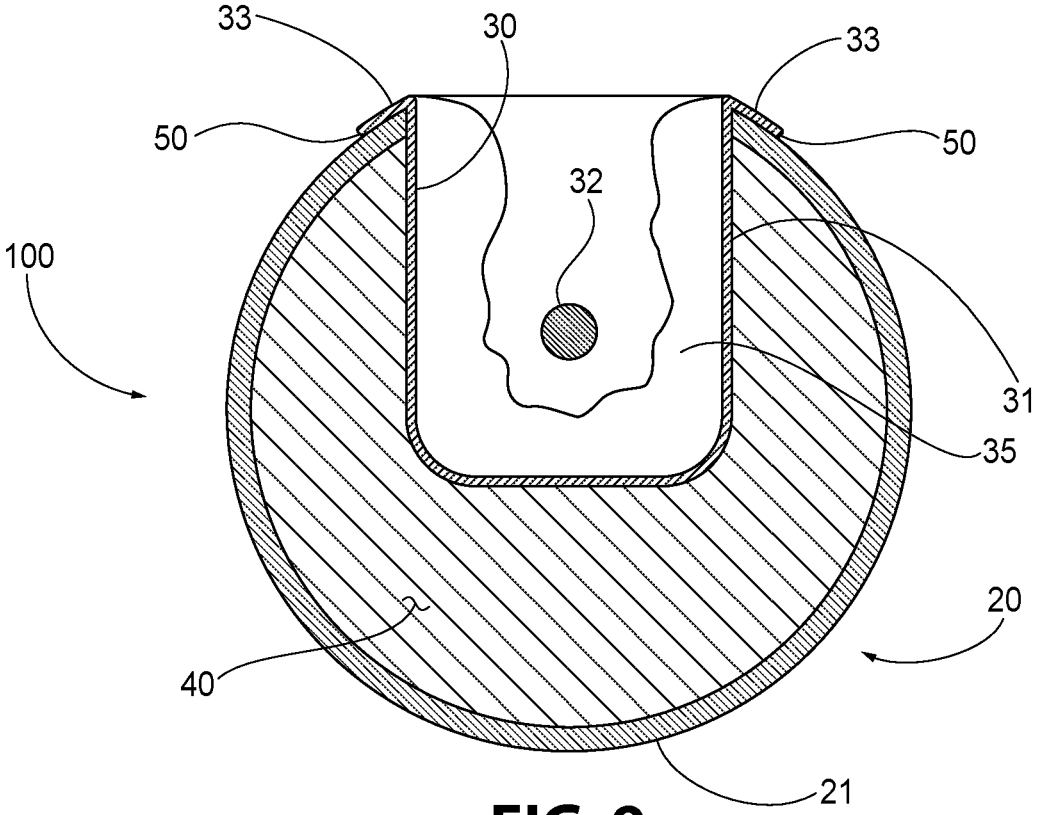
FIG. 9 is a side view of the fitness ball of FIG. 8.

Referring now to FIGS. 8 and 9, the handle assembly 30 of the fitness ball 100 may include padding 35 at least partially lining the handle pocket 31. The padding 35 is adapted to conform to the shape of the user's hand to provide support and cushioning during use of the fitness ball 100. The padding 35 may be made of any suitable material, such as silicon or gel. Alternatively, the padding may have a batting or foam core encased by fabric or leather.

Figure 10:
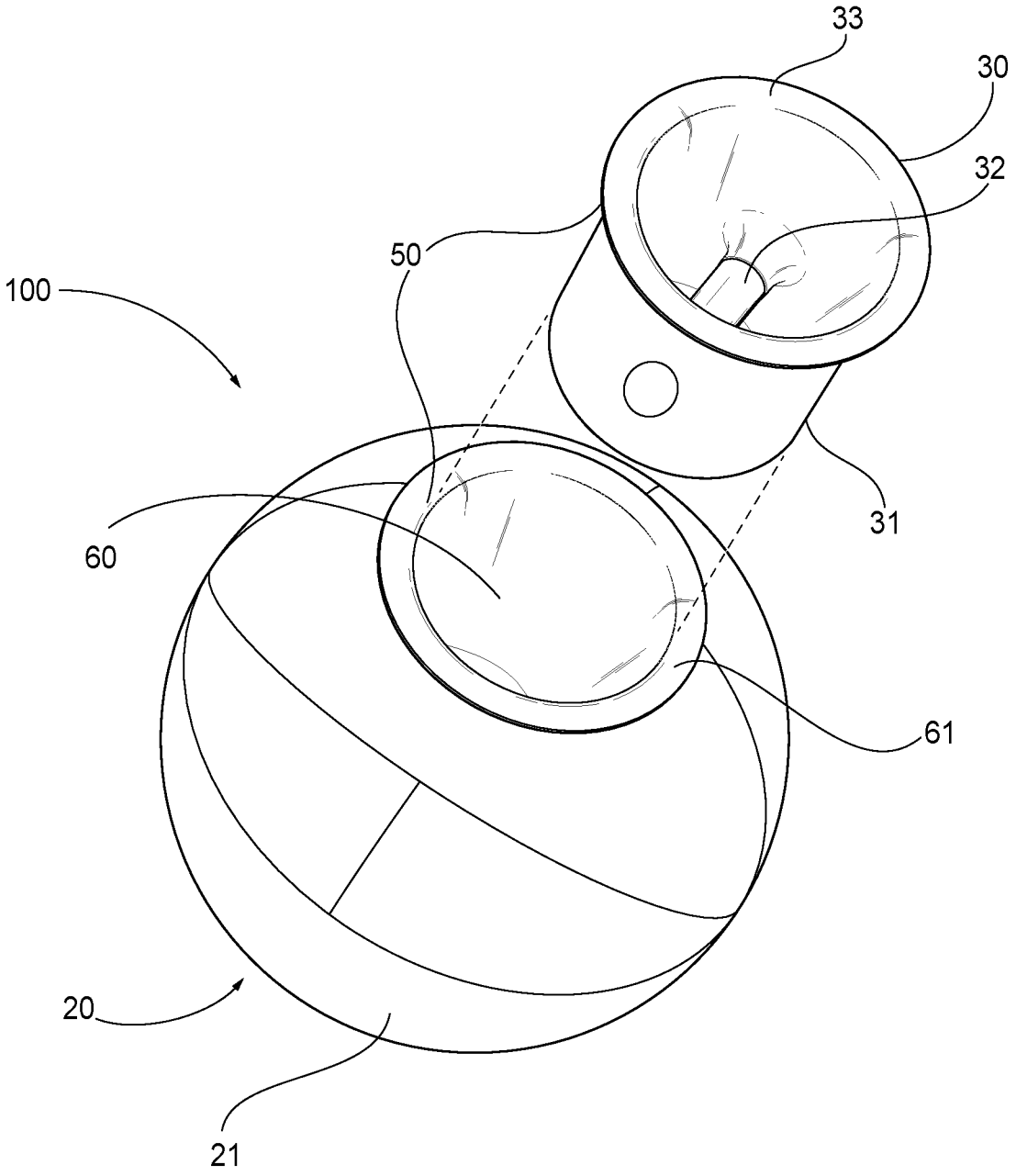
FIG. 10 is an exploded perspective view of a fitness ball according to another embodiment of the present invention.

Referring now to FIG. 10, the handle assembly 30 may be removable from the ball portion 20 in some embodiments of the fitness ball 100. In such embodiments, the handle assembly 30 may be substantially as described above in reference to FIGS. 1-9, except that the handle assembly 30 is not permanently affixed to the ball portion 20. Rather, a ball pocket 60 is disposed in the ball portion 20, and the handle assembly 30 is removably attached to the ball pocket 60. The ball pocket 60 may be made of a suitable material such as a polymer. The ball pocket 60 may include a lip 61 attached to the shell 21 of the ball portion 20 by glue, stitching, staples, rivets, or other fasteners known in the art. The lip 61 of the ball pocket 61 may define an attachment interface 50 with an underside of the lip 33 of the handle assembly 30.

Figure 11:
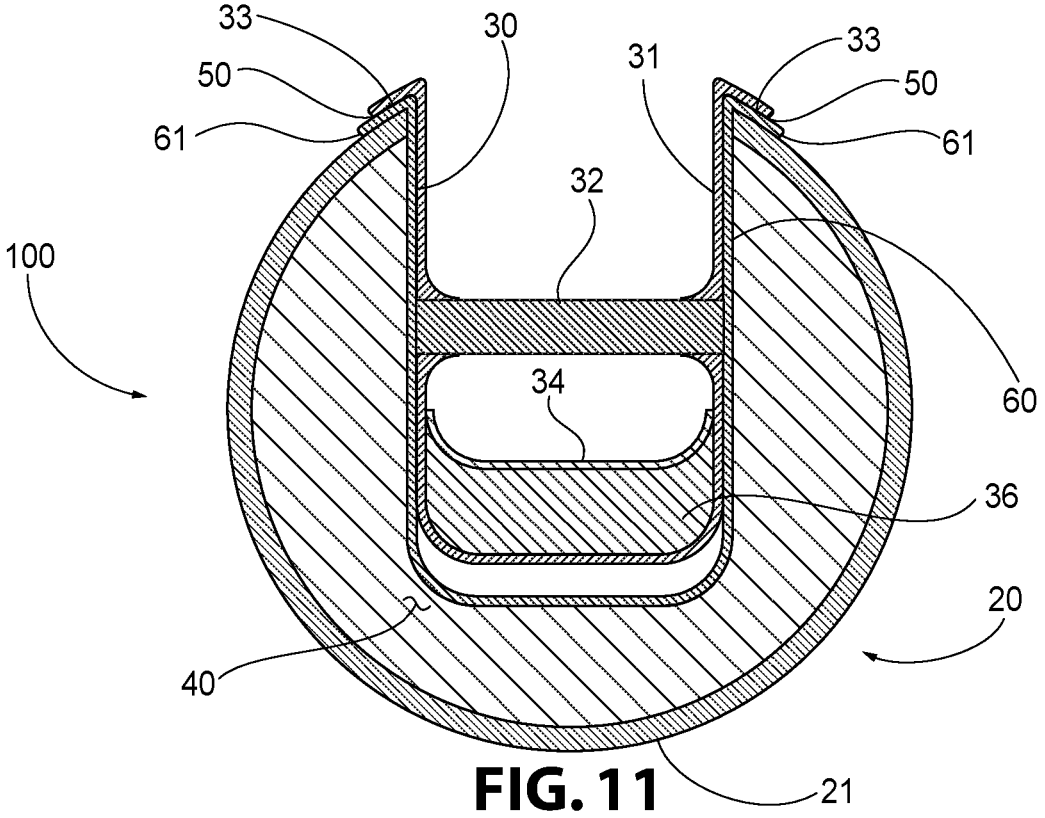
FIG. 11 is a side view of the fitness ball of FIG. 10 having a first example of a weighted handle assembly.
Figure 12:
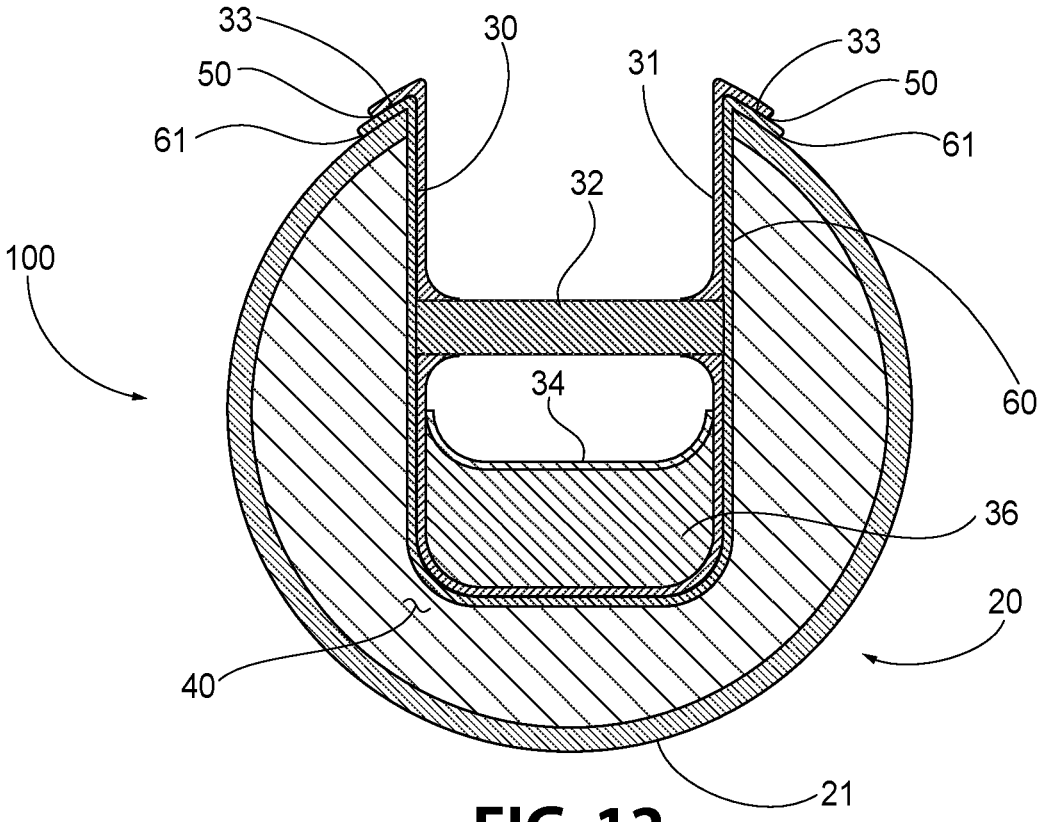
FIG. 12 is a side view of the fitness ball of FIG. 10 having a second example of a weighted handle assembly.

As may be appreciated from FIGS. 11 and 12, the handle assembly 30 fits into the ball pocket 60 with the lip 33 of the handle assembly 30 abutting the lip 61 of the ball pocket 60. Referring to FIG. 11, the ball pocket 60 may extend deeper into the ball portion 20 than the handle assembly 30, thereby allowing handle assemblies 30 of different depths to be attached to the ball pocket 60. This arrangement permits the user to attach different size handle assemblies 30, and particularly handle assemblies 30 having different weights, to one ball portion 20. For example, the handle assembly 30 illustrated in FIG. 11 has a weighted portion 36 smaller than the weighted portion 36 of the handle assembly 30 illustrated in FIG. 12, yet the handle assemblies 30 of both FIGS. 11 and 12 fit in the same ball portion 20. As such, the user may change the handle assembly 30 of the fitness ball 100 as desired to increase or decrease the weight of the fitness ball 100. The weighted portion 36 may be integrally formed with the handle pocket 31, or may be a formed of a different material that the handle pocket 31 and embedded in the handle pocket 31. In some embodiments, the weighted portion 36 may be a metal block overmolded with the handle pocket 31. In other embodiments, the weighted portion 36 may be affixed to the outside of the handle pocket 31. The weighted portion 36 may also extend along the sides of the handle pocket 31 to distribute the weight of the weighted portion 36 about a centroid of the fitness ball 100, the handle 32 of the fitness ball 100, or any other predetermined point in space encompassed by the fitness ball 100, as desired.

Figure 13:
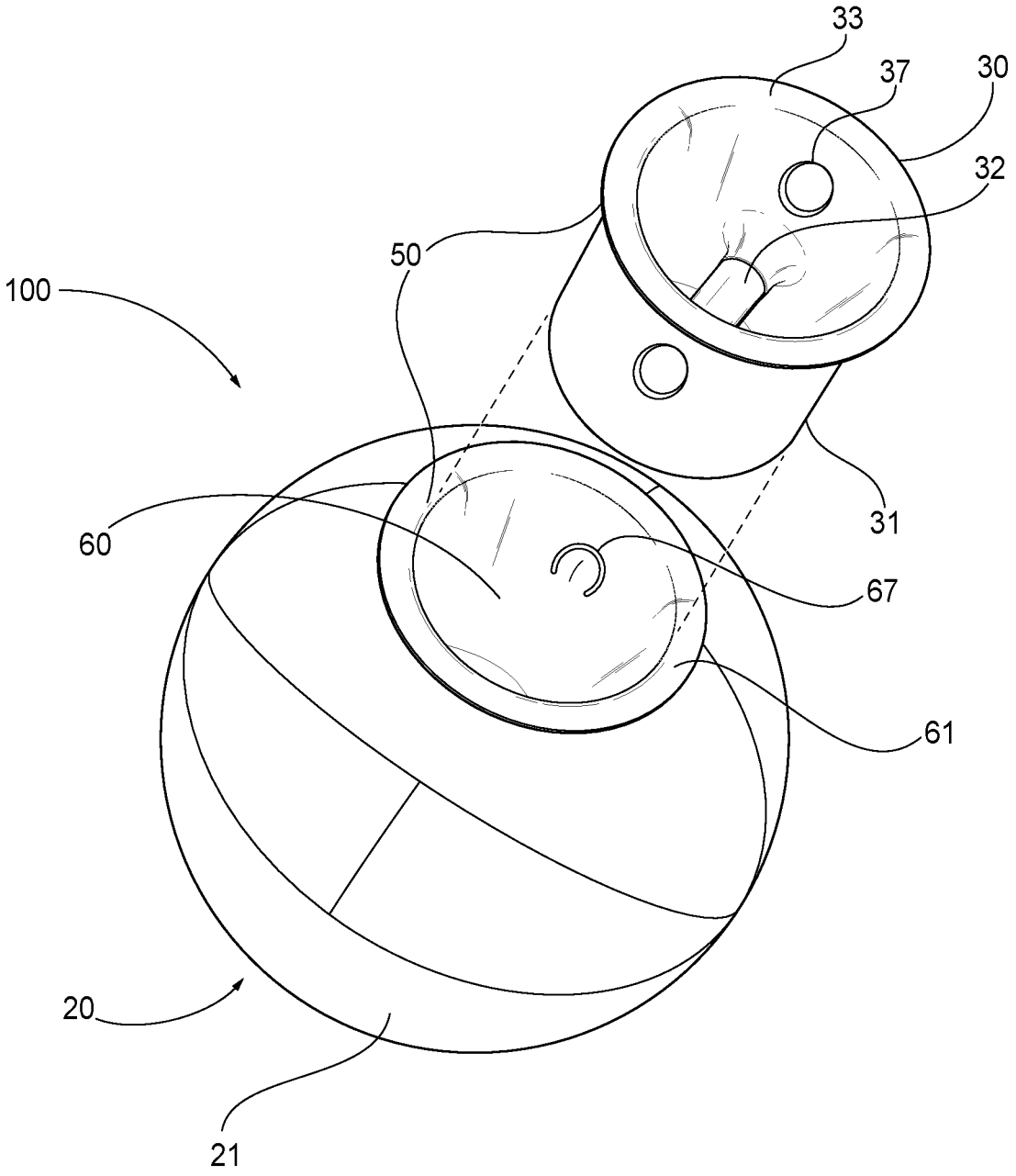
FIG. 13 is an exploded perspective view of the fitness ball of FIG. 10 having a first example of a handle attachment arrangement.
Figure 14:
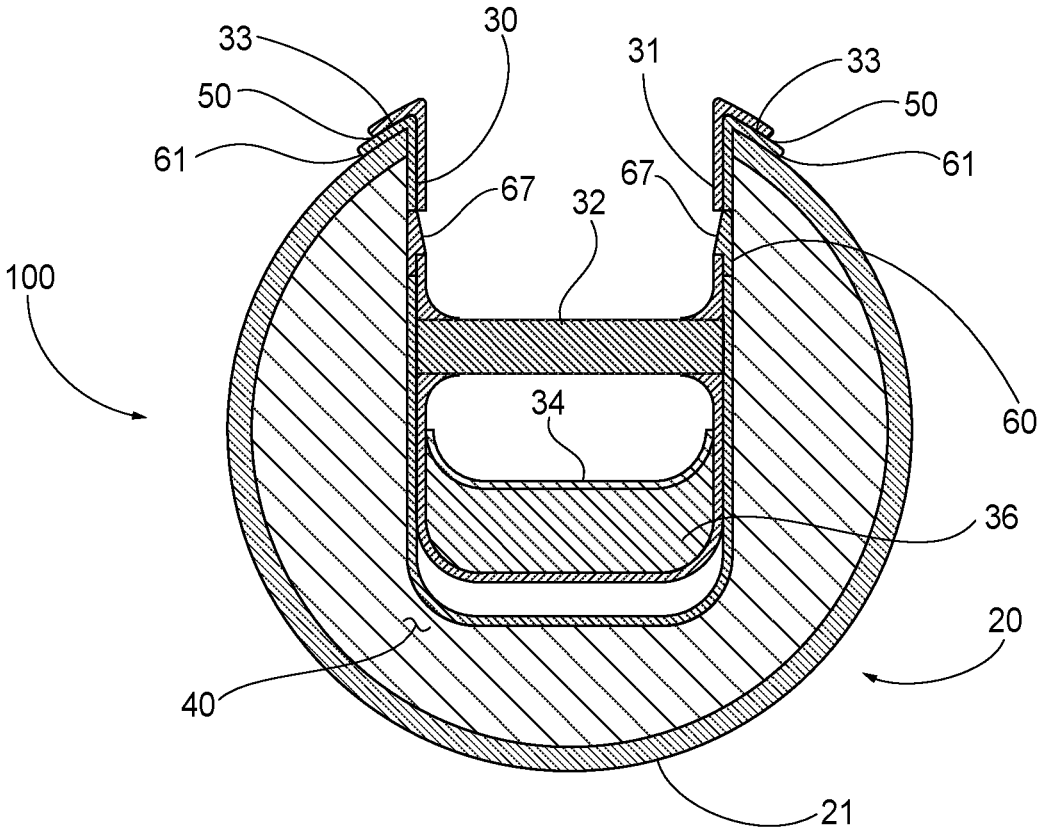
FIG. 14 is a side view of the fitness ball of FIG. 13.

Referring now to FIGS. 13-16, various arrangements for attaching the handle assembly 30 to the ball pocket 60 may be provided. In FIGS. 13-14, in some embodiment of the fitness ball 100, the ball pocket 60 includes at least one deflectable tab 67 that engages a corresponding aperture 37 or indentation in the handle assembly 30. Each deflectable tab 67 is biased toward the center of the ball pocket 60, creating an interference fit with aperture 37 of the handle assembly 30. Each deflectable tab 67 may, for example, be biased by a resilient portion attaching the deflectable tab 67 to the ball pocket 60, or by a spring disposed between the deflectable tab 67 and the ball pocket 60. To detach the handle assembly 30 from the ball pocket 60, each deflectable tab 67 may be depressed by the user concurrently with pulling the handle assembly 30 out from the ball pocket 60.

Each deflectable tab 67 may include an inclined surface or ramp to facilitate quick attachment of the handle assembly 30. In particular, the handle assembly 30 may engage the inclined surface or ramp of each deflectable tab 67 as the handle assembly 30 is inserted into the ball pocket 60, thereby depressing each deflectable tab 67 until the handle assembly 30 is fully inserted. When the handle assembly 30 is fully inserted into the ball pocket 60, each deflectable tab 67 snaps into the corresponding aperture 37 of the handle assembly 30. Snapping of each deflectable tab 67 into the corresponding aperture 37 of the handle assembly 30 may also provide audible confirmation that the handle assembly 30 is attached to the ball pocket 60.

Figure 15:
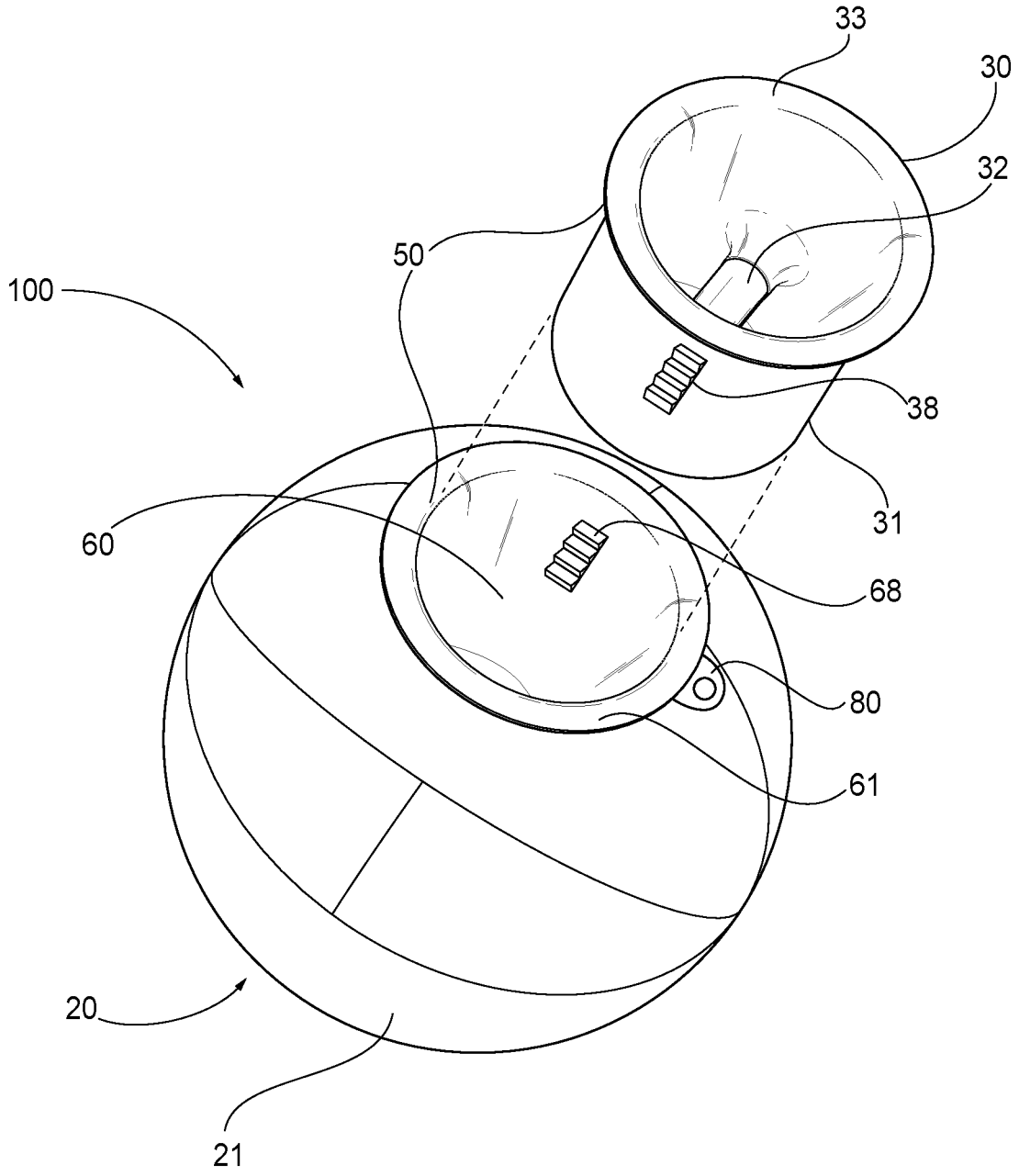
FIG. 15 is an exploded perspective view of the fitness ball of FIG. 10 having a second example of a handle attachment arrangement.

Referring now to FIG. 15, some embodiments of the fitness ball 100 may include one or more sets of stationary teeth 38 disposed on an outer surface of the handle assembly 30 and configured to engage one or more sets of corresponding ratcheting teeth 68 disposed on an inner surface of the ball pocket 60. Each set of ratcheting teeth 68 may be radially retractable away from the handle assembly 30 to facilitate inserting the handle assembly 30 into the ball pocket 60. The stationary teeth 38 and ratcheting teeth 68 include corresponding inclined surfaces arranged such that the handle assembly 30 may be freely inserted into the ball pocket 60 in a ratcheting action, but the handle assembly 30 may not be removed from the ball pocket 60 without additional action taken by the user. In some embodiments, a disengagement elements, which may be a button 80, is provided on the fitness ball 100 that allows the handle assembly 30 to be removed from the ball pocket 60. In particular, pressing the button 80 may articulate one or more linkages causing the ratcheting teeth 68 to radially retract away from the handle assembly 30, thereby disengaging the ratcheting teeth 68 from the stationary teeth 38 of the handle assembly 30. Thus, with the button 80 depressed, the handle assembly 30 may be removed from the ball pocket 60. In other embodiments, the disengagement elements may be a lever, dial, switch or other device known in the art capable of effecting retracting of the ratcheting teeth 68 of the ball pocket 60.

In other embodiments, the teeth 38 of the handle assembly 30 may be ratcheting and the teeth 68 of the ball pocket 60 may be stationary, and pressing the button 80 would cause the teeth 38 of the handle assembly 30 to radially retract away from the teeth 68 of the ball pocket 60.

Figure 16:
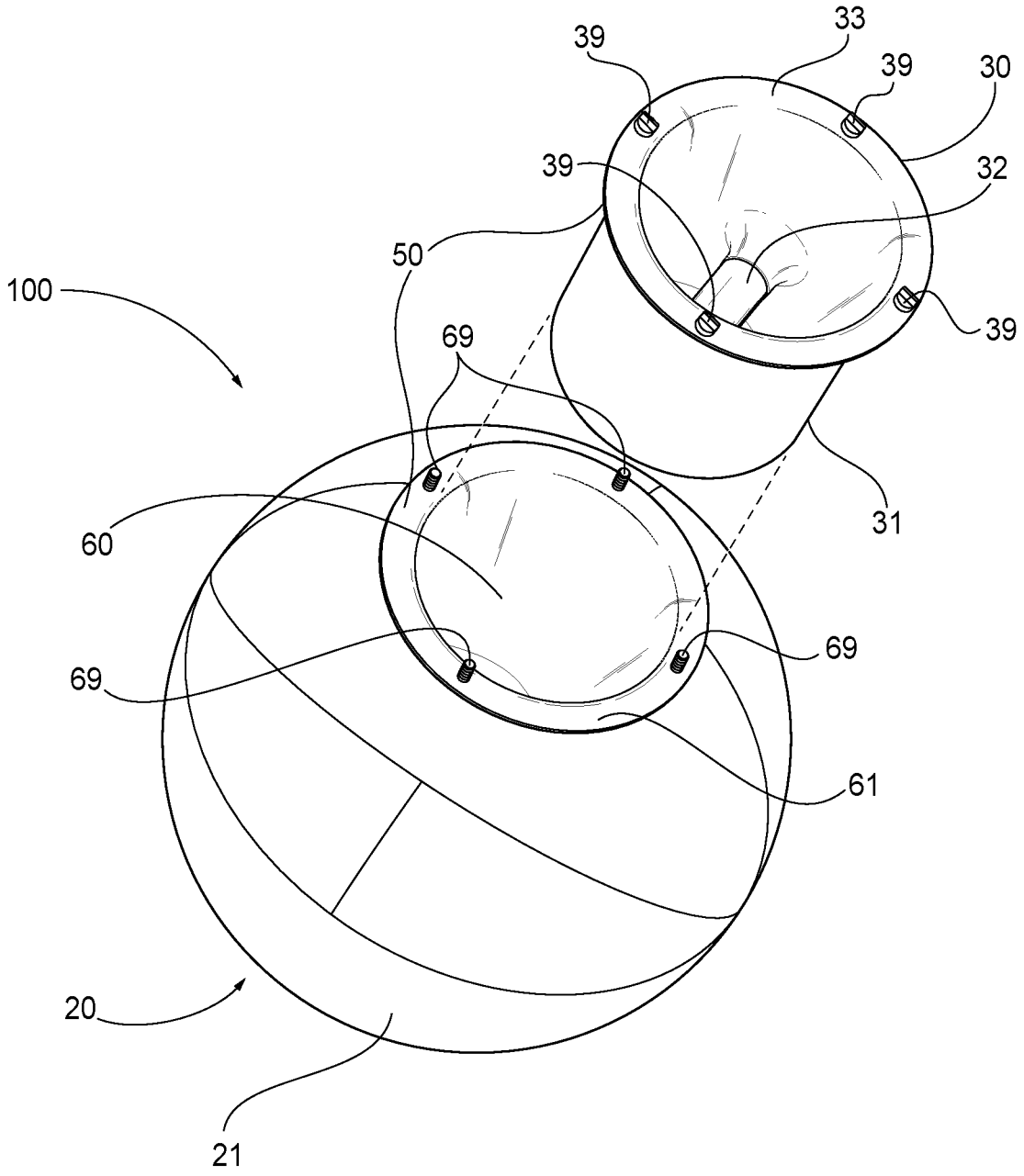
FIG. 16 is an exploded perspective view of the fitness ball of FIG. 10 having a third example of a handle attachment arrangement.
Figure 17:
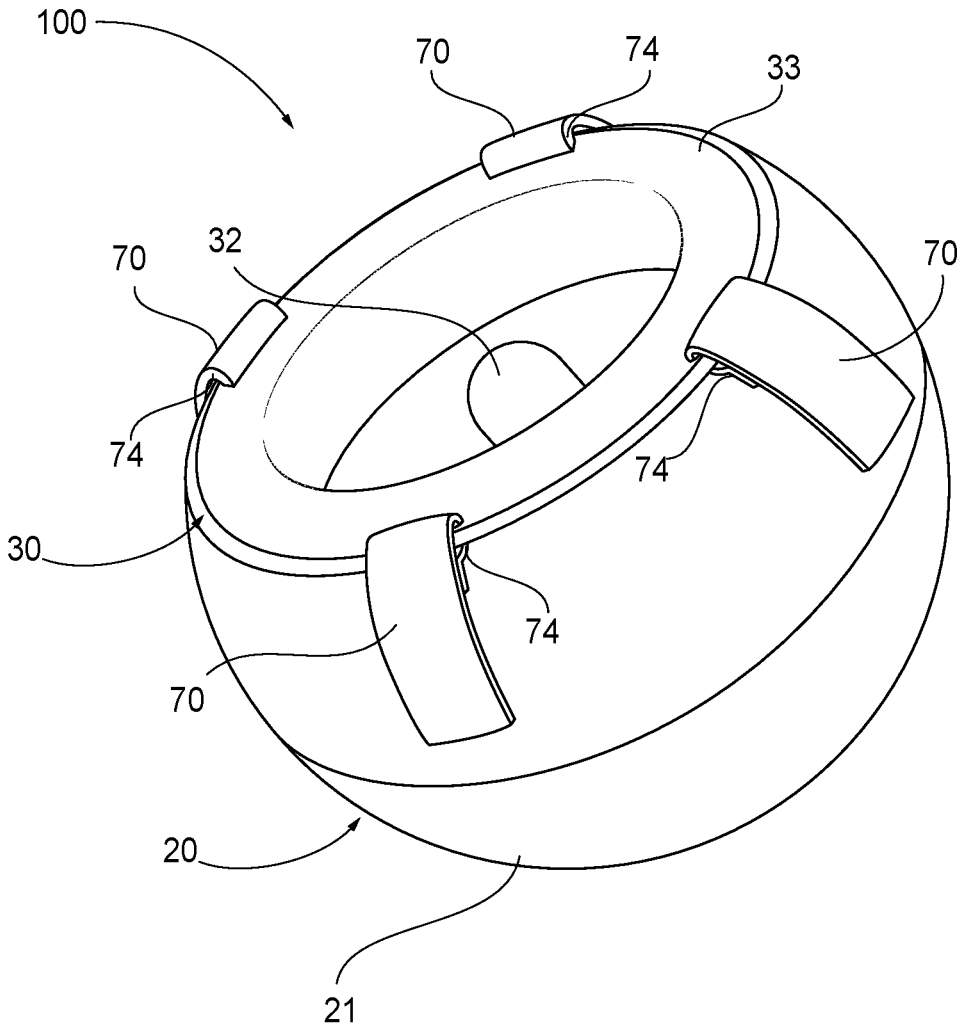
FIG. 17 is a perspective view of a fitness ball according to another embodiment of the present invention.
Figure 18:
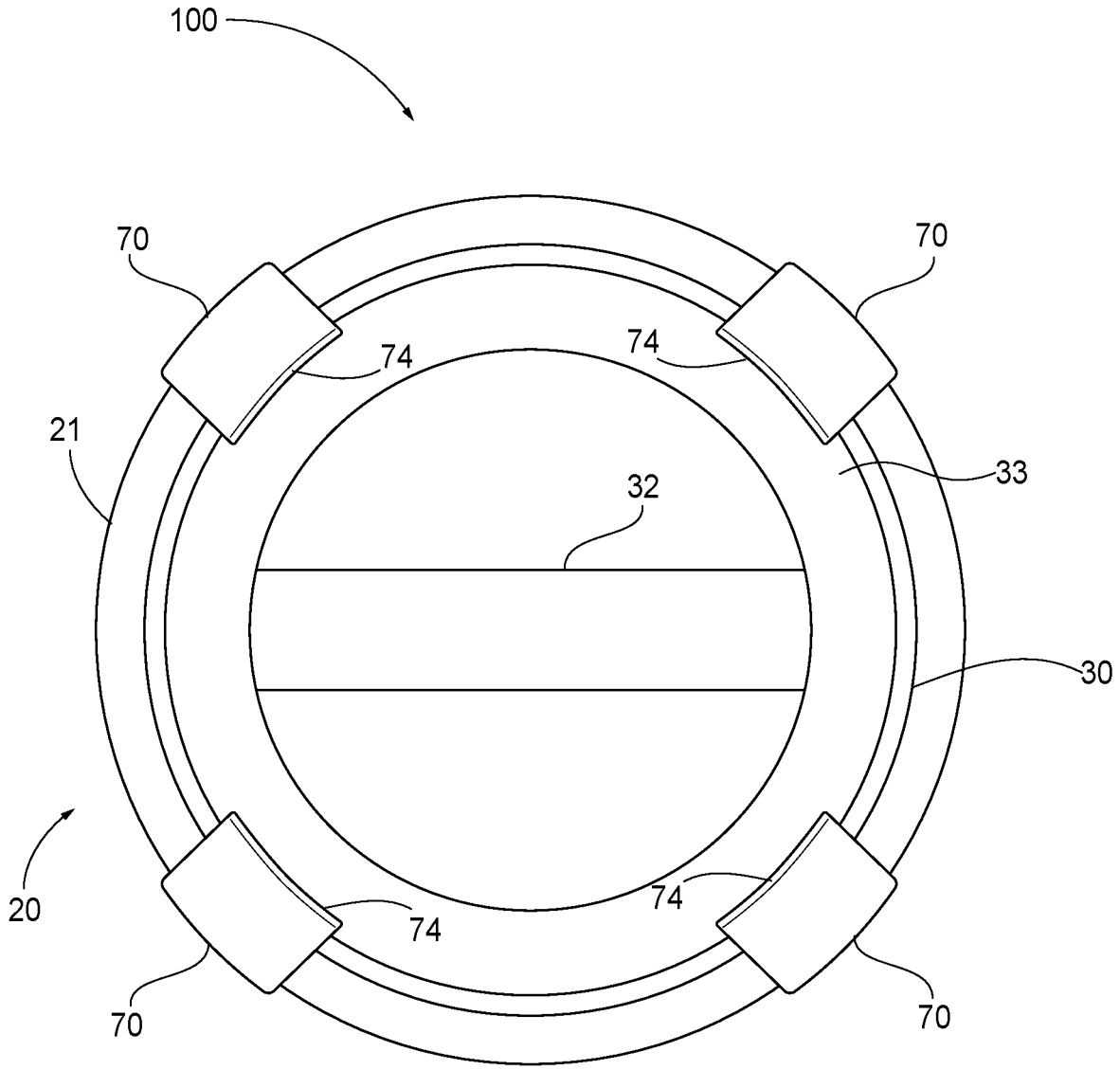
FIG. 18 is a top view of the fitness ball of FIG. 17.

Referring now to FIG. 16, some embodiments of the fitness ball 100 may include one or more threaded studs 69 extending from the ball portion 20 and/or the ball pocket 60, with the threaded studs 69 configured to cooperate with one or more bores 39 in the handle assembly 30. With the handle assembly 30 inserted into the ball pocket 60, the threaded studs 69 extend through the corresponding bores 39 in the handle assembly 30 such that a thumb nut 90 may be screwed onto each of the threaded studs 69 to secure the handle assembly 30 to the ball portion 20. Each of the bores 39 in the handle assembly 30 may be countersunk to at least partially cover the thumb nuts 90.

Referring now to FIGS. 17-20, some embodiments of the fitness ball 100 may include one or more straps 70 extending from the handle assembly 30 and configured to removably attach to an outer surface of the ball portion 20. In some embodiments, the straps 70 may be a natural or synthetic fabric, such that the straps 70 may be manually positioned around the contour of the shell 21. Each strap 70 may include a loop 74 extending through a slot in the lip 33 of the handle assembly 30 to rotatably secure the strap 70 to the handle assembly 30. In some embodiments, the straps 70 may removably attach to the ball portion 20 via a hook-and-loop or hook-and-pile fastening system, such as Velcro®. For examples, the straps 70 may include a plurality of hooks, and the shell 21 of the ball portion 20 may include a plurality of loops to which the hooks of the straps 70 attach. A portion of the shell 21 may be made of a pile fabric to which the hooks of the straps attach. For example, a portion of the shell 21 extending radially outward from the handle assembly 30 and 360° around handle assembly 30 may be a pile fabric. As such, the straps 70, when pressed against the outer surface of the ball portion 20, will engage pile fabric regardless of the rotational orientation of the handle assembly 30 relative to the ball portion 20.

In other embodiments, the straps 70 may removably engage the ball portion 20 via an adhesive applied to one or both of the straps 70 and the ball portion 20. In yet other embodiments, the straps 70 may removably engage the ball portion 20 via mechanical fasteners of one or both of the straps 70 and the ball portion 20. For example, the straps 70 and the ball portion 20 may include corresponding, engageable parts of a snap. In other examples, the ball portion 20 may include buttons configured to engage slits or eyes in the straps 70, or vice versa.

Figure 19:
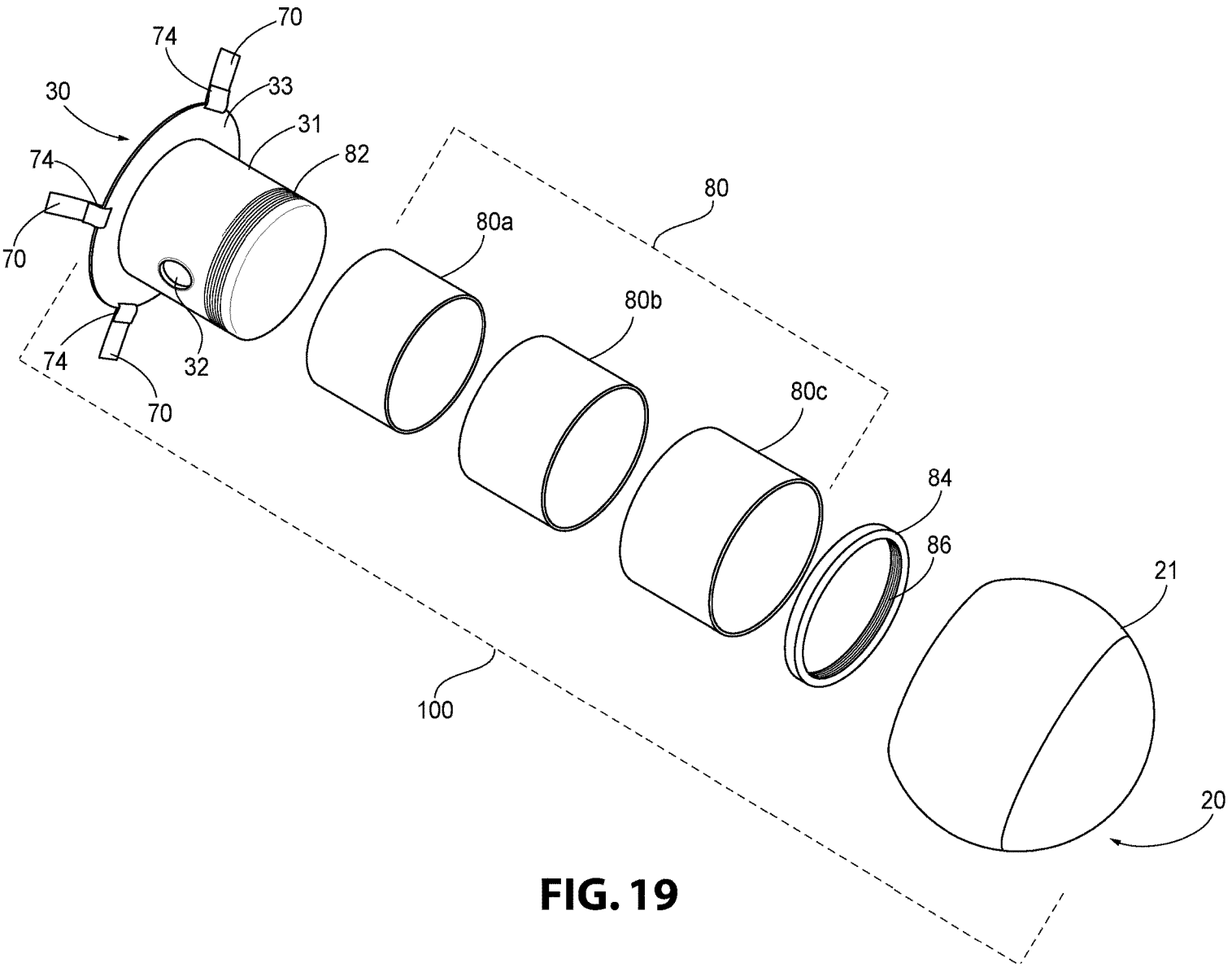
FIG. 19 is a exploded perspective view of the fitness ball of FIG. 17.
Figure 20:
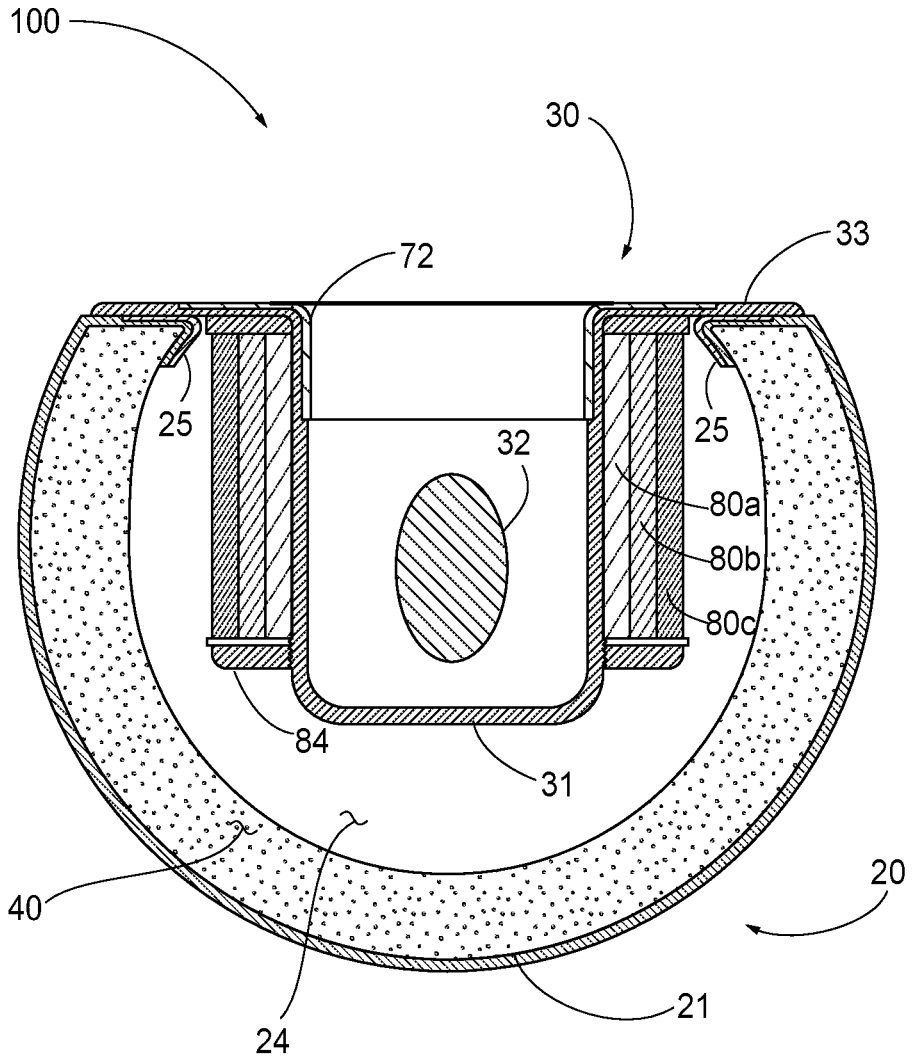
FIG. 20 is a cross sectional side view of the fitness ball of FIG. 17.

With continued reference to FIGS. 19-20, in some embodiments, the fitness ball 100 may include one or more weighted rings 80 which fit concentrically around the exterior of the handle assembly 30. The one or more weighted rings 80 may also fit concentrically around one another such that more than one weighted ring 80 may be used at a time. In the embodiment shown in FIGS. 19-20, a third weighted ring 80*c* fits concentrically around a second weighted ring 80*b* which in turn fits concentrically around a first weighted ring 80*a*. The one or more weighted rings 80 are slidable over the handle pocket 31 and into abutment with the lip 33. As shown in FIGS. 19-20, the one or more weighted rings 80 may be hollow cylinders, though other shapes are understood to be within the scope of the present invention. A retaining ring 84 may be slid over the handle pocket 31 to secure the weighted rings 80 to the handle assembly 30. In some embodiments, the retaining ring 84 includes an internal thread 86 configured to engage an external thread 82 formed on the handle pocket 31. As such, the retaining ring 84 may be screwed onto the handle pocket 31 to secure the weighted rings 80 to the handle assembly 30. In other embodiments, the retaining ring 84 may be secured to the handle pocket 31 with mechanical fasteners such as clips or clamps.

One or more gaskets may be provided between the one or more weighted rings 80 and the lip 33 of the handle assembly to cushion the one or more weighted rings 80 against the lip 33. Similarly, one or more gaskets may be provided between the one or more weighted rings 80 and the retaining ring 84 to cushion the one or more weighted rings 80 against the retaining ring 84.

By installing one or more of the weighted rings 80, a user may adjust the weight of the fitness ball 100. The one or more weighted rings 80, once installed concentrically around the handle pocket 31 and secured with the retaining ring 84, may be inserted along with the handle assembly 30 into the ball portion 20. The handle assembly 30 including the one or more weighted rings 80 may fit into a cavity 24 defined by the filer material 40. The straps 70 may then be secured to the ball portion 20 as described above to place the fitness ball 100 in condition for use.

Referring particularly to FIG. 20, in some embodiments of the ball portion 20, the shell 21 may include a lip 25 which folds over an upper portion of the filler material 40 to retain the shell 21 around the filler material 40. The lip 25 of the shell 21 may include an elastic band or an adhesive to assist in securing the shell 21 to the filler material 40. In such embodiments, the ball pocket 60 of FIGS. 10-16 may be omitted because the shell 21 is secured directly to the filler material 40 and the handle assembly 30 is secured directly to the shell 21. In some embodiments, the handle assembly 30 may include a resilient pad 72 extending around an inner surface of the handle pocket 31 to cushion a user's hand and/or forearm during contact with the handle assembly 30.

In use, the fitness ball 100 allows the user to perform a variety of exercises that would traditionally require several pieces of fitness equipment. For example, the ball portion 20 allows the fitness ball 100 to be used as a traditional medicine ball, and the handle assembly 30 allows the fitness ball 100 to be used as a dumbbell or kettlebell. The fitness ball 100 may also be used in boxing and martial arts training. For example, a user may hold the fitness ball 100 while punching a wall or other surface, eliminating the need for a punching bag or speed bag. The impact absorbing properties of the shell 21 and the filler material 40 prevent user injury and damage to the wall or other punching surface. Many other uses for the fitness ball 100 across multiple training platforms such as CrossFit®, mixed martial arts (MMA), and others may also be appreciated based on the above detailed description.

Because the fitness ball 100 may be used in as a substitute for several pieces of traditional fitness equipment, the fitness ball 100 is particularly well adapted for circuit training or high intensity interval training where the user performs several different exercises in rapid succession. The versatility of the fitness ball 100 allows the user to perform multiple exercise without losing time from switching between different pieces of fitness equipment. Further, the versatility of the fitness ball 100 may reduce the amount of fitness equipment necessary to complete a training regimen, potentially saving the user both space and money.

While various embodiments of the fitness ball 100 were provided in the foregoing description, those skilled in the art may make modifications and alterations to these embodiments without departing from the scope and spirit of the invention. For example, it is to be understood that this disclosure contemplates that, to the extent possible, one or more features of any embodiment can be combined with one or more features of any other embodiment. Accordingly, the foregoing description is intended to be illustrative rather than restrictive. The invention described hereinabove is defined by the appended claims, and all changes to the invention that fall within the meaning and the range of equivalency of the claims are to be embraced within their scope.

The invention claimed is:

1. A fitness ball comprising:

a ball portion having a generally spherical-shaped resilient shell;

a pocket disposed in the ball portion and defining an opening in the ball portion;

a weighted portion integrally formed or attached to the pocket on an opposite side of the pocket relative to the opening; and a handle extending from a first point on an inner surface of the pocket to a second point on the inner surface of the pocket;

wherein the pocket comprises a lip extending outward from a perimeter of the opening and overlapping the ball portion, the lip providing an attachment interface with the ball portion.

2. The fitness ball of claim 1, further comprising an impact-absorbent filler material disposed in an inner cavity defined by the resilient shell and the pocket.

3. The fitness ball of claim 2, wherein the filler material is a mixture of cotton and rubber pellets.

4. The fitness ball of claim 2, wherein the filler material is silicone.

5. The fitness ball of claim 1, wherein the handle is formed of a different material than the pocket and is embedded into the inner surface of the pocket at the first point and the second point.

6. The fitness ball of claim 1, wherein the pocket and the handle are formed as an integrally molded assembly.

7. The fitness ball of claim 1, wherein the pocket is adhered to the resilient shell by an adhesive disposed between an interfacing portion of the resilient shell and the lip of the pocket which overlaps the interfacing portion of the resilient shell.

8. The fitness ball of claim 1, wherein the pocket is adhered to the resilient shell by a stitched connection between the resilient shell and the lip of the pocket which overlaps an interfacing portion of the resilient shell.

9. The fitness ball of claim 1, further comprising padding at least partially lining the pocket.

10. The fitness ball of claim 1, wherein the opening extends only partially through the ball portion.

11. The fitness ball of claim 1, wherein the pocket is cylindrical.

12. A fitness ball comprising:

a ball portion having a generally spherical-shaped resilient shell defining a cavity therein; and a handle assembly insertable into the cavity of the ball portion and removably attached to the ball portion, the handle assembly comprising:

a handle pocket defining an opening configured to receive a user's hand;

a weighted portion integrally formed or attached to the handle pocket on an opposite side of the handle pocket relative to the opening; and a handle extending from a first point on an inner surface of the handle pocket to a second point on the inner surface of the pocket;

wherein the handle assembly further comprises a lip extending outward from a perimeter of the opening of the handle pocket and overlapping the ball portion, the lip providing an attachment interface with the ball portion.

13. A fitness ball comprising:

a ball portion having a generally spherical-shaped resilient shell defining a cavity therein; and a handle assembly insertable into the cavity of the ball portion and removably attached to the ball portion, the handle assembly comprising:

a handle pocket defining an opening configured to receive a user's hand;

a weighted portion integrally formed or attached to the handle pocket; and a handle extending from a first point on an inner surface of the handle pocket to a second point on the inner surface of the pocket;

wherein the handle assembly further comprises a lip extending outward from a perimeter of the opening of the handle pocket and overlapping the ball portion, the lip providing an attachment interface with the ball portion;

wherein the weighted portion comprises:

one or more weighted rings configured to fit concentrically around at least a portion of the handle pocket.

14. The fitness ball of claim 13, wherein a second of the one or more weighted rings is configured to fit concentrically around a first of the one or more weighted rings.

15. The fitness ball of claim 13, further comprising a retaining ring configured to engage the handle pocket to secure the one or more weighted rings to the handle assembly.

16. The fitness ball of claim 12, further comprising a ball pocket disposed in the ball portion and defining an opening in the ball portion.

17. The fitness ball of claim 12, further comprising:

one or more straps extending from the handle assembly, the one or more straps removeably attachable to the ball portion.

18. The fitness ball of claim 12, wherein the cavity extends only partially through the ball portion.

* * * * *